US006054643A

United States Patent [19]

Chance et al.

[11] Patent Number: 6,054,643

[45] Date of Patent: Apr. 25, 2000

[54] GUITAR PICK WITH GRIPPING MEANS

[75] Inventors: Allen Chance, Marina Del Rey; William T. Gray, Topanga, both of Calif.

[73] Assignee: Big Rock Engineering, Topanga, Calif.

[21] Appl. No.: 09/166,035

[22] Filed: Oct. 5, 1998

Related U.S. Application Data

[60] Provisional application No. 60/061,277, Oct. 7, 1997.

[51] Int. Cl.[7] ..... G10D 3/16

[52] U.S. Cl. ..... 84/322; 84/315; 84/320; 84/321

[58] Field of Search ..... 84/315, 320, 321, 84/322, 329

[56] References Cited

U.S. PATENT DOCUMENTS

| | | | |
|---|---|---|---|
| D. 257,151 | 9/1980 | Burke | D17/20 |
| D. 260,529 | 9/1981 | Pearse | D17/20 |
| D. 310,233 | 8/1990 | Farnell, Jr. | D17/20 |
| D. 317,171 | 5/1991 | Saks | D17/20 |
| D. 336,102 | 6/1993 | Hodesh | D17/20 |
| D. 356,593 | 3/1995 | Purcell | D17/20 |
| D. 385,293 | 10/1997 | Sarno | D17/20 |
| 557,293 | 3/1896 | Wahl . | |
| 1,009,403 | 11/1911 | Gaynor . | |
| 1,184,561 | 5/1916 | Napoletano . | |
| 1,573,912 | 2/1926 | Burdwise . | |
| 2,170,179 | 8/1939 | Wolcott | 84/322 |
| 3,442,169 | 5/1969 | Bowers . | |
| 3,735,663 | 5/1973 | Cowell, Sr. | 84/322 |
| 3,789,720 | 2/1974 | McIntyre | 84/322 |
| 4,020,732 | 5/1977 | Kelly | 84/322 |
| 4,137,814 | 2/1979 | Rowley | 84/322 |
| 4,150,601 | 4/1979 | Henley, Jr. | 84/322 |
| 4,347,773 | 9/1982 | Zook | 84/322 |
| 4,497,237 | 2/1985 | Beall | 84/322 |
| 4,691,609 | 9/1987 | Acocella | 84/322 |
| 4,843,942 | 7/1989 | Ishizuka | 84/322 |
| 5,271,308 | 12/1993 | Balog | 84/322 |
| 5,307,722 | 5/1994 | La Rosa | 84/322 |
| 5,341,715 | 8/1994 | Hucek | 84/322 |
| 5,419,228 | 5/1995 | Garrett et al. | 84/322 |
| 5,483,859 | 1/1996 | Singer | 84/322 |
| 5,509,341 | 4/1996 | Dunlop . | |
| 5,610,349 | 3/1997 | Fogarty et al. | 84/322 |
| 5,837,913 | 11/1998 | Newman | 84/329 |

*Primary Examiner*—Brian Sircus
*Assistant Examiner*—Marlon T. Fletcher
*Attorney, Agent, or Firm*—Sitrick & Sitrick

[57] ABSTRACT

An ergonomic musician's pick or pick holder for use with string instruments, such as a guitar, mandolin, bass guitar, or ukelele, has a curved finger grip portion on one side adapted to form a finger cradle for either the thumb or index finger of a user and has a flat generally planar area on another side against which the other fingers of a user may be pressed to allow the user to securely and comfortably grasp the pick for playing. The grip portion positively locates the fingers in a generally predetermined angular relationship to the string engaging pick tip. Different individual picks of the invention may have different angular relationships. The pick functions in the same way to bring the same advantages of the invention to any conventional and some non-standard or custom picks. Holder provides the added advantage that various picks may be used and the angular relationship may be more easily varied through various arrangements for attaching the pick to the holder. The simplicity of construction allows use of various materials in various thicknesses, sizes, and hardnesses, and materials to satisfy a wide range of playing conditions and preferences. The pick and holder have a folded configuration which is efficiently manufactured and allows convenient storage on the instrument strap or stings. The ergonomic grip design allows a more relaxed, and low pressure grip which is less likely to cause physical problems such as carpal tunnel syndrome and arm and back pain.

34 Claims, 8 Drawing Sheets

FIG. 18A
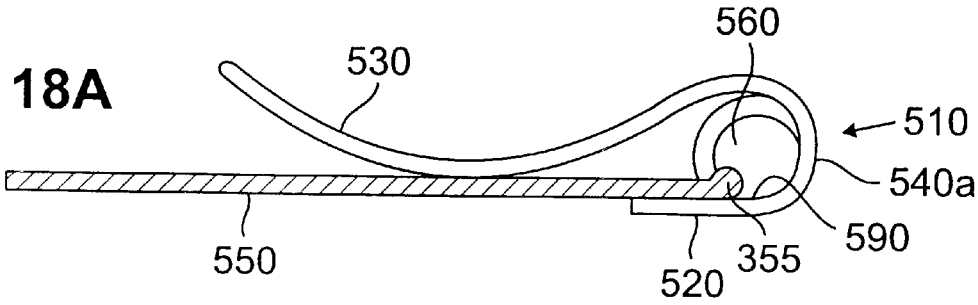
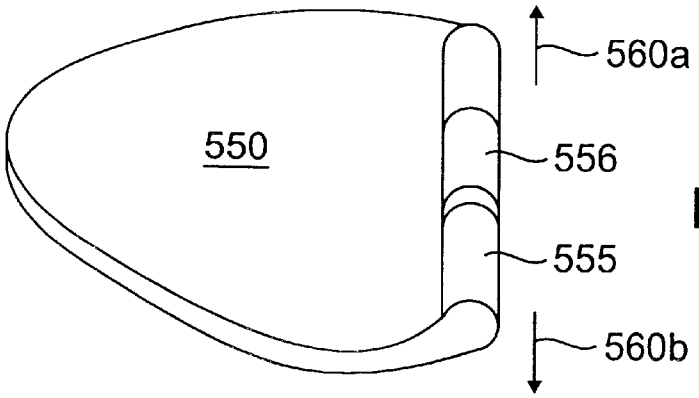
FIG. 18B
FIG. 18C
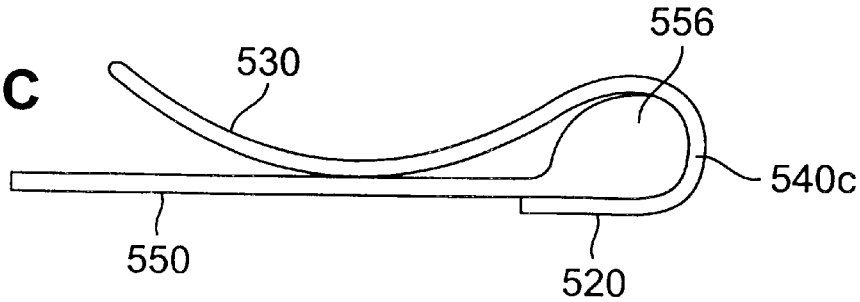

GUITAR PICK WITH GRIPPING MEANS

RELATED APPLICATIONS

This application is a continuation of provisional application Ser. No. 60/061,277 filed Oct. 7, 1997.

BACKGROUND OF THE INVENTION

1. Field of the Invention

The present invention relates generally to a pick for stringed instruments, and more particularly to a pick and pick holder device having an improved ergonomic grip that allows a more comfortable, less tense grip that avoids physical tension and stress related problems and facilitates improved playing.

2. Description of the Prior Art

Stringed instruments have been known since at least the Middle Ages and means for plucking these strings evolved from the use of pieces of sea shell and tortoise shells. As the stringed instruments, and particularly guitars, evolved and the intensity of the music increased to that now being played by rock bands on electric guitars, the requirement for improved gripping capabilities has similarly increased. With the faster, more intense playing, it is important that the conventional pick be gripped tightly and securely to achieve the proper pick alignment and possession. It has been found that with the tight gripping of the prior art picks, there has been a tendency for the picks to move in the user's finger and to cause stress and fatigue for the user.

The problem of providing adequate gripping capability for musical picks has been approached in many different ways in the prior art From the inventors' experience, picks have been made from various materials and in a variety of different shapes—some have been made with holes or with crosshatch non-slip patterns embossed into the plastic—but this never really achieved the positive grip that was sought. Some users put tape on a pick in order to achieve better gripping or have even taped or glued the pick to their thumbs.

Other attempts to overcome these problems are shown in U.S. Patents such as: U.S. Pat. No. 1,009,403 wherein a thumb receiving bowl is attached by means of a hollow rivet to a pick; U.S. Pat. No. 1,184,561 wherein a holder has a recessed finger receiving area; U.S. Pat. No. 1,573,912 wherein non-slip leather is used; U.S. Pat. No. 2,170,179 wherein opposite indentations each receive fingertips; U.S. Pat. No. 3,735,663 wherein the portion of the pick being held is curved; U.S. Pat. Nos. 4,020,732 and 5,509,341 wherein the pick is looped to surround a thumb; U.S. Pat. No. 4,150,601 including finger receiving channels on opposite sides of a pick; U.S. Pat. No. 4,347,773 wherein a pair of integral shoulders act as finger stops; U.S. Pat. No. 5,307,722 which discusses pick holding and includes a pick having a pair of right angle fins that promote improved grip; U.S. Pat. No. 5,419,228 in which a metal bar at one end has finger receiving grooves and U.S. Pat. No. 5,610,349 wherein cone-shaped protrusions provide a roughened finger gripping surface. In addition, other U.S. Patents, such as U.S. Pat. Nos. 557,293; 2,776,592; 3,442,169 and 3,789,720, include ring grips that encircle a finger for positive gripping.

With all the prior art devices, we and other users have never been satisfied with the grip they provide. It has been found the picks tend to move or "walk" around in between the thumb and index finger, thereby changing position and requiring increased concentration and constant adjustment in order to keep the pick in proper alignment for the desired attack on the strings. Perspiration or humid conditions greatly magnify the gripping problems. Simply put, the prior picks worked against the user rather than for the user. Also, from our experience, as a result of the prior art picks being tightly gripped, undue dampening and a deadened sound is produced. Another disadvantage with the prior art picks or pick holders is that they lack adjustment or adaptability, and cannot be customized to the individual preferences of different playing angles.

Despite the many attempts to improve the grip on a pick, there remains a long, unmet need for a simpler more ergonomic, better playing and convenient pick

SUMMARY OF THE INVENTION

These and other aspects and attributes of the present invention will be discussed with reference to the following drawings and accompanying specification.

According to the invention, there is provided an improved pick and holder device which may take the form of an integral pick and grip, or a pick holder that will accept any standard pick and some non-standard and custom picks, and hold them at any desired angle to provide the advantages of our invention to the conventional pick.

Generically, the invention provides a first portion having what we have characterized as a second or tongue or flap portion of material that may be characterized as being folded up and over the first portion with the second portion having a curved thumb or finger receiving configuration adapted to receive and securely hold one of a user's fingers against lateral movement with the other of the user's fingers being pressed against the first portion when it is a pick or against a secured plectrum, when it is a pick holder thereby allowing the user to securely and comfortably grasp the pick or holder for playing.

The improved pick or holder of the invention is simpler and more convenient than known picks or holder. Thus, it is a one piece pick or holder which preferably is made of suitable materials easily variable in thickness and stiffness that cover a wide range of playing conditions. Examples of such materials are plastics, metals or combinations thereof. It is easily fabricated by conventional means, such as die-cutting, bending, or injection molding. The folded over shape allows easy storage of the pick on the instrument or guitar strap, whereby, for example, as the user's pick usage requirements change during use, the user may quickly slide his current pick onto the storage means and pull off another pick of the same or different qualities without missing a beat or losing concentration.

The ergonomic shape of the pick of the present invention allows a more comfortable, less tense and less tiring grip that avoids stress, fatigue and the accompanying physical problems such as carpal tunnel syndrome and strain on the forearm and back. The curved grip in what may be variously characterized as a cradle or saddle or pocket shape allows the musician to securely grip the pick or holder regardless of the specific string playing angle of the pick chosen by the musician.

Improved playing results from the fact that the easy to hold, secure grip avoids dropping, and the user not having to worry about slippage and relative movement of the pick in the user's fingers. This improves the user's concentration on the music and technique. The aligned channel or saddle grip configuration promotes and actually teaches the user how to properly hold the pick whereby it functions as a teaching tool.

E-mail evaluation messages to the internet web site of the inventors, to wit:

"www.BIGROCKENG.COM", have consistently produced positive, appreciative and "rave" reviews indicating many benefits, including among other things that the users find the pick and holder of the invention produce what is characterized as a brighter and "more lively" sound that "makes old strings sound newer". These evaluations indicate in the inventors' minds the fulfillment of heretofore unmet needs and evidence of unexpected results.

Contributing to these desirable effects is the fact that the present invention's construction, only one finger of the user fully contacts one side of the pick surface as the other gripping finger is cradled away from full contact with the other surface of the pick. Because the dampening effect on the pick of finger contact and reduction of high gripping pressure—in the order of half—it amplifies the "English pick scrape" sound as well as the harmonics and other percussive effects.

The present invention permits the pick to really become an instrument unto itself, providing its own adaptive characteristics to the sound of the respective stringed instrument. Thus, the pick itself can be tuned by varying the amount of pick scrape as, for example, by squeezing and moving the curved finger receiving portions toward the planar pick portions, respectively. Furthermore, the pick and holder construction does not preclude conventional dampening processes whereby, for example, the thumb may be moved toward the string engaging tip of the pick.

BRIEF DESCRIPTION OF THE DRAWINGS

Various other objects and teachings of the invention will become apparent when reference is made to the following detailed description considered in conjunction with the accompanying drawings, in which:

FIGS. 18A and 18B show another embodiment wherein the pick has an enlarged portion along one side which may be slid into the holder to secure it in place.

DETAILED DESCRIPTION OF PREFERRED EMBODIMENTS

Figure 1:
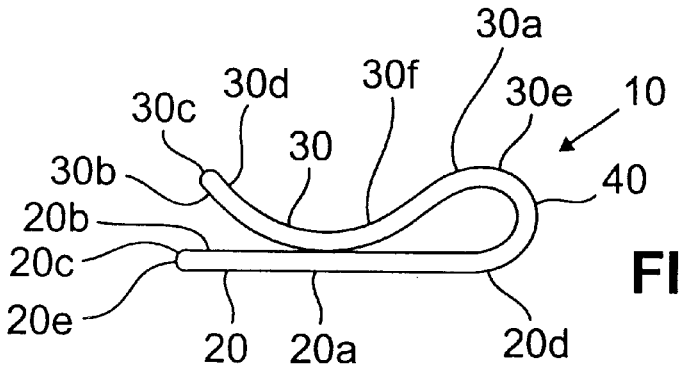
FIG. 1 is a side elevational view of a preferred embodiment of a musician's pick according to the present invention.
Figure 2:
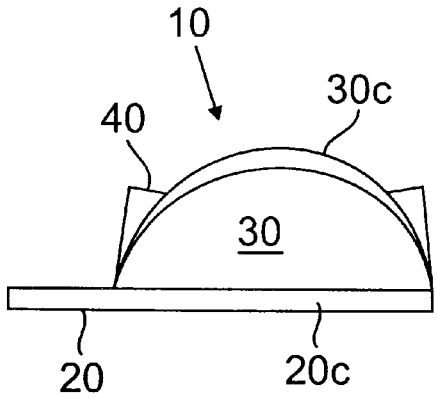
FIG. 2 is a front elevational view from the left of the pick of FIG. 1.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Figure 3A:
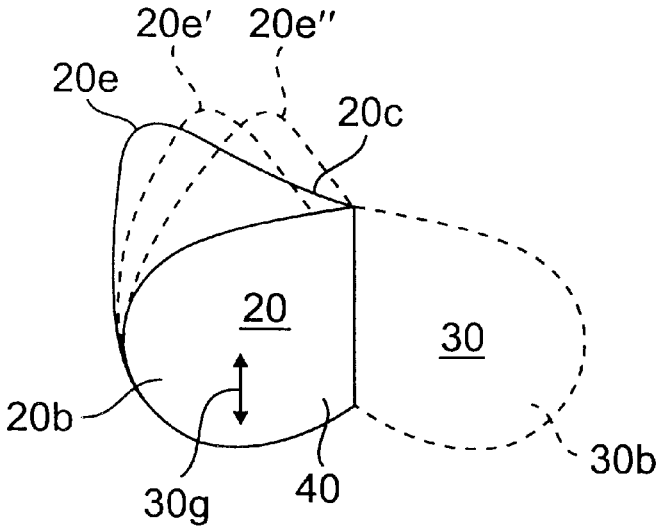
FIG. 3A is a plan view of the pick of FIG. 1 with various examples of possible pick tip angles and shows in dotted lines a plan view of an unfolded pick of FIG. 1.
Figure 3B:
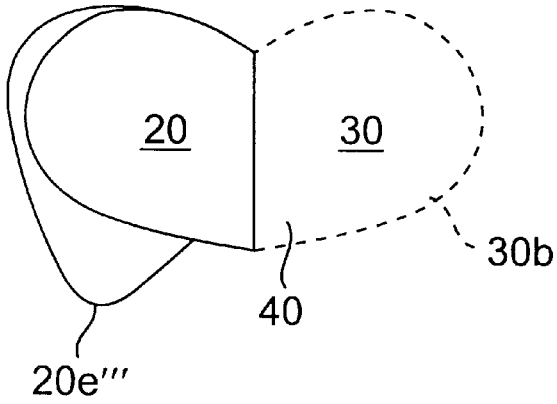
FIG. 3B shows in dotted lines a plan view of the pick of FIG. 1 with yet another example of a pick tip angle.
Figure 4:
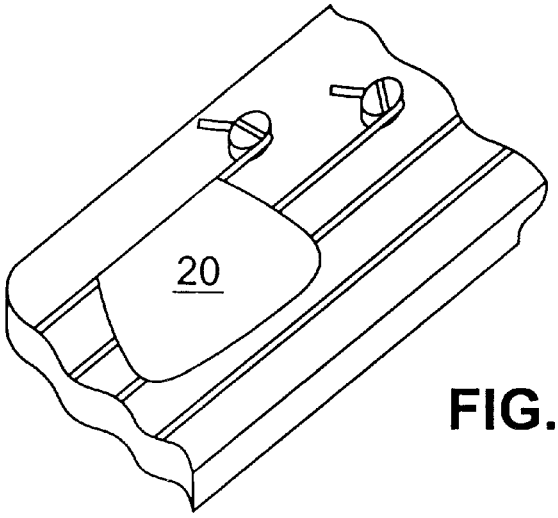
FIG. 4 is a schematic of a pick as it might be stored on the instrument during use.

Referring now specifically to the drawings, a first embodiment of the invention is shown in FIG. 1, wherein a pick for a stringed instrument generally indicated at 10 is shown to include a planar first position 20 having a second or clip or non-slip grip portion 30 folded thereover. The non slip grip portion 30 has a curved outer surface 30*a* in the form of what may be characterized as a pocket or thumb or finger cradle or indentation curvature 30*f*. The portion 30 includes an inside surface 30*b*, a surrounding edge 30*c*, a bottom area 30*d* and an upper portion 30*e*. Upper and bottom are relative to a tip portion 20*e*. As shown in FIG. 1, the cradle 30 may be said to have an axis perpendicular to the paper which would be in a vertical direction 30*g* in FIGS. 3A and 3B. The first and second portions 20, 30, typically contact each other in the area 30*f* in the direction 30*g* when at rest and certainly when gripped by the user. The first or body portion 20 may be generally planar and include a generally planar outer surface 20*a*, and a generally planar inner surface 20*b*, a surrounding edge 20*c*, a connecting portion 20*d*, and a string engaging tip portion 20*e*. As shown in FIGS. 3A and 3B, the string engaging portion or tip 20*e* may be oriented to be at various angles to the direction 30*g* of the finger grip portion 30 to accommodate different grips and individual preferences on playing angles and instruments. The string engaging portion 20*e* may be in a range of angles as represented as extending for example from 20*e*, 20*e*' and 20*e*" in FIG. 3A to 20*e*'" in FIG. 3B. FIG. 3A shows a range of angles between the direction 30*g* of the cradle 30*f* and the position of the tip 20*e*. Here it may be understood that with different fold lines, and in some cases different blank shapes, the tip position or relative angle to 30*g* may be easily varied by, for example, 20*e* to 20*c*' to 20*e*" to 20*e*'". The portions 30*e* and 20*d* are shown connected by an intermediate curved portion 40. The intermediate portion 40 is folded over more than 180° as shown from a comparison of FIGS. 1, 3A, and 3B. FIG. 3B is effectively the same blank as 3A, except that the second portion 130 has been folded in the opposite direction.

This allows easy accommodation for both right and left handed players.

The grip portion 30*f* is shown to include a generally cylindrically curved portion extending from approximately 30*d* to 30*e* and adapted to mate with and receive one of the two fingers usually used by the player to hold the pick. As shown in FIGS. 1 and 3A, the portions 20, 30, and 40 may be integrally formed.

Figure 8:
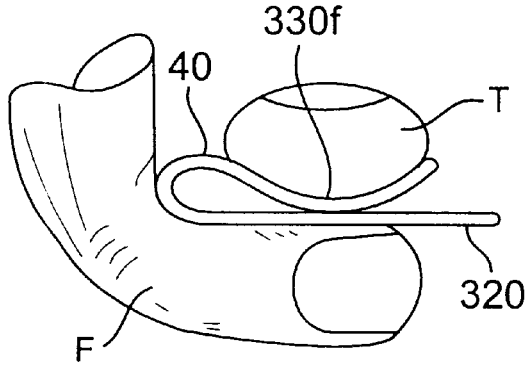
FIG. 8 is a view of the pick of FIGS. 6 and 7 being held with the thumb.

The embodiments of FIGS. 6A, 6B, 7, and 8 are similar in construction with portions 320, 320*a*, 330, 330*g*, 340, 330*f*, and 320*e* corresponding to portions 20, 20*a*, 30, 30*a*, 40, 30*f*, and 20*e*, respectively, however the orientation to the hand of the user as shown in FIG. 8 has the user's thumb T in the finger cradle 330*f* and the index finger F below against portion 320*a* and the angle of the tip 320*e* approximately perpendicular to the direction 330*g*. This compares with the orientation shown in FIG. 5 wherein the index finger F is in the cradle 30*f* and the thumb is against surface 20*a*.

An important advantage of the invention is that the device according to the invention may be easily made by the steps of forming the portions 20, 30, and 40 in a generally planar shape, as shown in FIGS. 3A and 3B, through processes such as die-cutting or injection molding, and then bending the first or flap portion 30 over the second portion 20 through a 180°+ bend. The bending steps may include a heat treating of the material. The materials which lend themselves to this process of manufacturer include celluloid, plastic and metal type materials. In most cases, the holder of FIGS. 9–18 will be metal, although new high strength synthetic materials or combinations thereof may be used.

Alternatively, the device may be made by injection molding a plastic material into a mold shaped as the finished product, allowing the material to cure and removing the device from the mold and then finishing the material. In such a case, where the two flaps meet in a mold, a second operation may be necessary to separate the portion.

Figure 10:
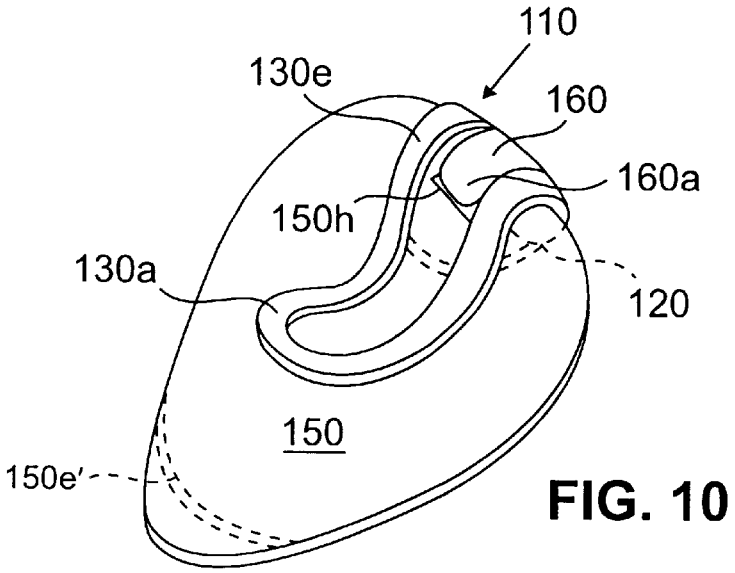
FIG. 10 is an enlarged preferred embodiment of the present invention in the form of a pick holder retaining a plectrum.
Figure 11:
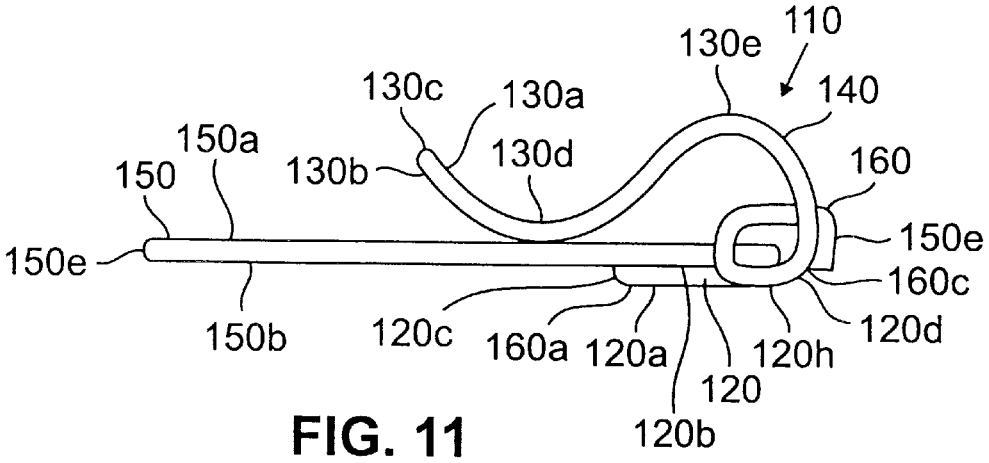
FIG. 11 is-an alternate preferred-embodiment of the present invention in the form of a pick holder retaining a plectrum.

Referring to FIGS. 10 and 11, there is shown a pick-holder embodying the advantageous concepts of the invention. Thus, as shown in FIG. 11, a first portion 120 includes an outer surface 120*a* and an inner surface 120*b* surrounded by an edge 120*c*. A second or curved portion which may be characterized as a grip, pocket or cradle portion 130 is connected to the first portion 120 through an intermediate portion 140. Portion 130 includes an outer surface 130*a*, an inner surface 130*b*, an edge 130*c*, therebetween a curved thumb or finger receiving pocket 130*d*, and a connecting portion 130*e*. As shown, the portion 140 curves more than on the order of 180° between a portion 120*d* of the first portion and a portion 130*e* of the second portion.

The exact configuration of string engaging tips 20*e*, 150*e* may be varied as desired from point to a round radius shown, for example, by the dotted lines 150*e*' in FIG. 10.

Figure 9A:
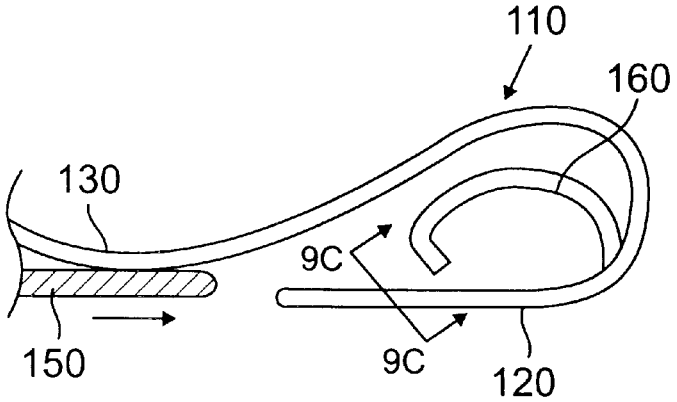
FIGS. 9A and 9B illustrate the insertion into and securing of a pick into a pick holder of the invention.
Figure 9B:
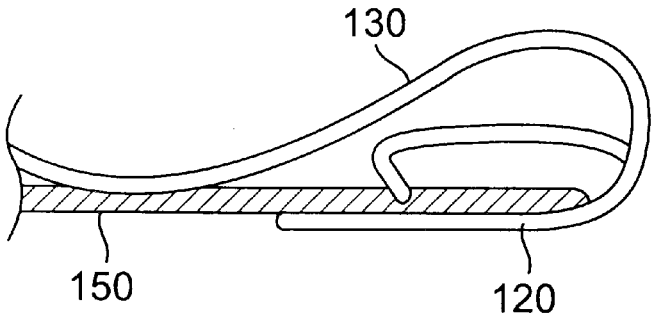
Figure 9C:
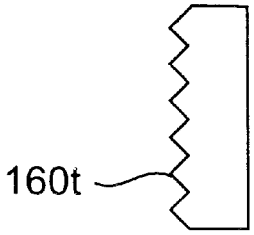
FIG. 9C is a view along 1X—1X of FIG. 9A showing of an example of pick securing means on a portion of the pick holder of FIG. 9A.
Figure 17A:
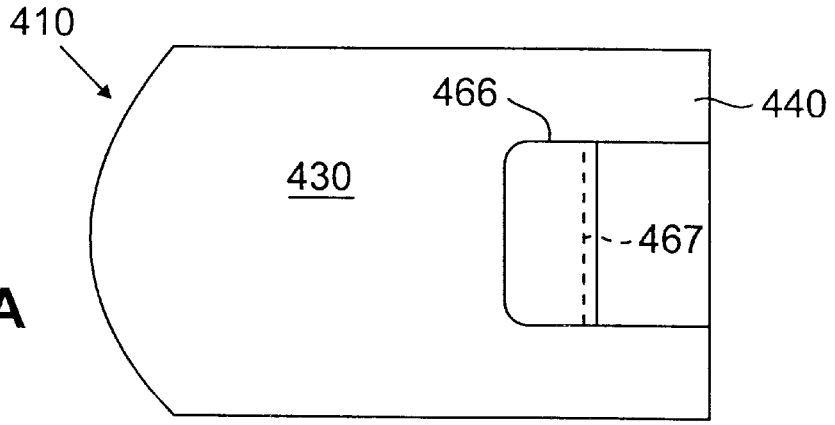
FIGS. 17A and 17B show yet another embodiment of a pick holder and pick securing means.
Figure 17B:
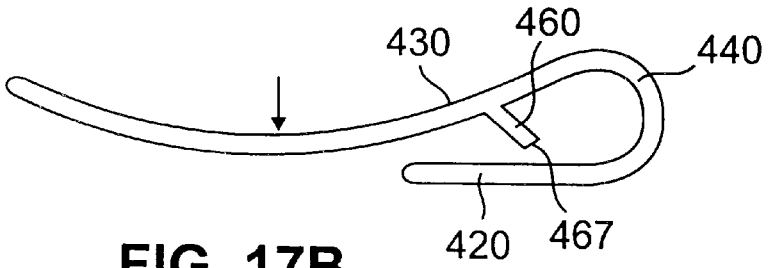

FIGS. 17A and 17B illustrate another alternative pick securing means 460, here shown angled toward portion 420 whereby a pick, not shown, may be moved in various directions ala FIGS. 9A and 9B, but secured by end portion 467 against opposite outward movement. Here also, it will be noted that the finger rest portion 430 may have a greater radius or radii than comparable portions 30 and 130, for example. Also, a comparison with 130 of FIG. 10 shows an open center in 130 versus a closed center. Varying these aspects will allow more or less finger or thumb pressure and/or pressure to be directly applied to the pick, thereby varying playing conditions, such as dampening to produce relatively different degrees of "brightness" and effectively tune the pick.

Another means for securing a pick in a holder is illustrated by FIGS. 18A–18C, wherein a pick has an enlarged portion 355 of a size adapted to slide into and fit snugly in a laterally extending space 590 adjacent the bridging or connecting portions 540*a* or 540*c*. In FIG. 18A, the securing member 560 of a type disclosed herein holds the pick in place wherein in FIG. 18C, a further enlarged portion 556 snaps into an opening in the portion 540*c* or 530.

The first and second portions may have a gap therebetween, as shown in FIGS. 9A and 9B, which serve to receive and capture a plectrum or pick 150. FIG. 9B shows the tab 160 after external force was applied to urge the teeth 160*t* shown in FIG. 9C, into the plectrum 150. With this approach, and using proper yet simple jigs and equipment for fabrication, including cutting , alignment, and crimping, the position of the pick relative to the finger or thumb receiving grip potion 130 may be infinitely varied and accurately and precisely fabricated to meet nearly every user's request, including without limitation, angle, material, hardness, flexibility, shape, size, and thickness. The plectrum 150 may be of any standard, or in some non-standard and custom types whereby the users will not be limited in the type of pick that they are using but yet will obtain all of the advantages of the invention. Since the receiving portion including the inside surfaces 120*b* and 130*b* may accommodate differing thicknesses, sizes and shapes, the holder unit 110 becomes quite versatile. The spacing between 160*t* and 120, or 467 and 420, and the possible spring load may be adjusted or may require different models to accommodate picks of greatly different thicknesses. Thus, if the gap is set for a pick 0.015 thick, it may not receive or push down on a pick 0.045 thick. Here, the adjustments may be in the physical properties of portion 160 including stiffness, flexibility, and resilience, for example. We have found that metal provides the, best results for the manufacture of the holders 110, 410, and 510. When these various types of plectrums are used, we have found that it is advantageous to provide a tab or locking member or holder attachment means 160. This attachment member 160 may be from the same material or integrally formed with the portions 120, 130, and 140, or may be a separate securing means that is partially connected with 110 or separate therefrom such as a staple or brad (not shown). In one embodiment, locking member 160 may be formed as a resilient spring biased toward 120 and urging the locking member end 160*a* into contact with a holder attachment mens on the pick 150. This attachment means may be an opening or indentation 150*e* in the pick 120.

As a further embodiment, as shown in FIGS. 10 and 11, a hole 120*h* may be formed in the first portion 120 whereby the tip 160*a* extends through an opening 150*h* and hole 120*h* as well. A suitable snap fit means will hold the end 160*a* in the holes 150*h* and 120*h*. The holder 110 may be manufactured in a manner similar to the pick as disclosed in connection with the embodiment of FIGS. 1–7. In such a case, the lock or tab 160 could be cut from portions 130 with a first end 160*c* remaining integral therewith and bent or otherwise fabricated.

Figure 16:
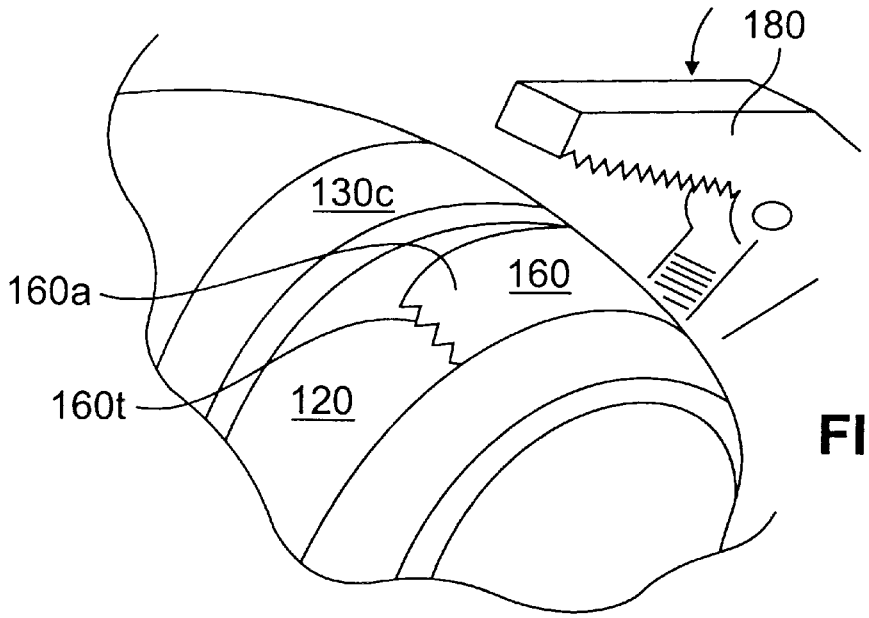
FIG. 16 is a partial view of the pick gripping tab of FIGS. 9A–C schematically showing an embodiment wherein the pick is mechanically fastened as by crimping the holder tab to the plectrum.

Although we have shown in FIGS. 9A and 9B one way to connect holder 110 and pick 150, there are many different ways this may be effectively accomplished. Thus, as shown in FIG. 16, the tab or lock 160, having teeth 160*t* or similar pick and holder engaging means, may be slipped over the pick 150 and holder 120, and pinched together by suitable means, such as the pliers schematically shown at 180. Swaging or adhering, not shown, may also be used. The important thing is that a secure bond be effected between the two.

Figure 12:
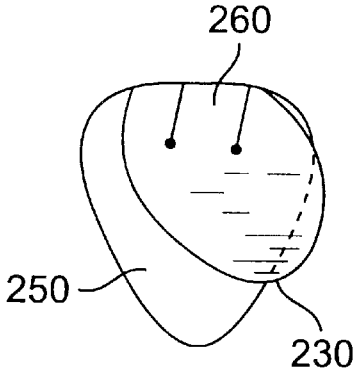
FIGS. 12–14 are plan views of similar embodiments of pick holders having prongs engaging slots or indentations that are set at various positions to illustrate the varying angles and positions at which picks or pick portions may be held by the holders.

FIGS. 12–15 illustrate another simple and effective way a wide variety of different angles and holder pick attitudes may be achieved by a minimum number of different parts. Thus, FIG. 12 shows how the grip portion 230 may be offset from the vertical axis of the pick 250 if required or desired. Again, 260 may attach the pick to the holder in any of the disclosed ways.

Figure 13:
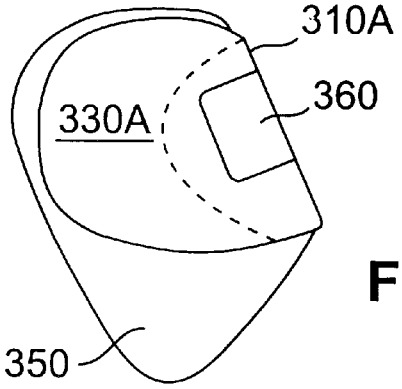
Figure 14:
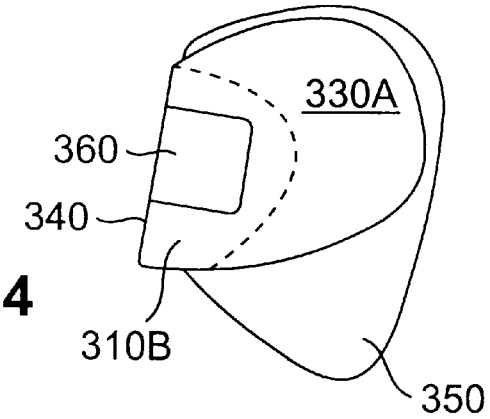
Figure 15:
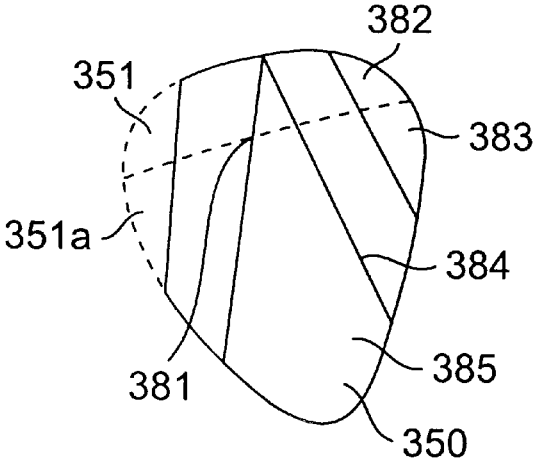
FIG. 15 shows the pick per se of FIG. 14 with inscribed lines thereon.

FIGS. 13 and 14 illustrate how a single pick 350, as shown by itself in FIG. 15, may be flipped over to be accommodated in two different holders 310*a* and 310*b*. The pick 350 has shoulder portion 351 removed along line 351A and a suitable holder engaging means 381, such as a slot, whereby when pick 350 is secured positioned with line 351 adjacent and parallel to portion 340 in 310*a* and 310*b*, and secured by securing member 360, it will serve two purposes. Further on site customizing of pick 350 will be facilitated by guide lines or markings, such as shown at 382–385. Also, the picks may be prefabricated with a suitable holder engaging means at various predetereened positions as for example in or along the guidelines.

Figure 5:
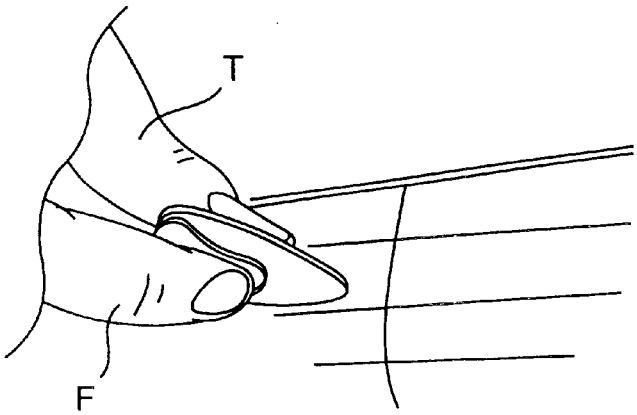
FIG. 5 is a schematic of a pick according to the present invention of FIGS. 1–3 being held in the hand of a user with the index finger in the curved saddle portion.
Figure 6A:
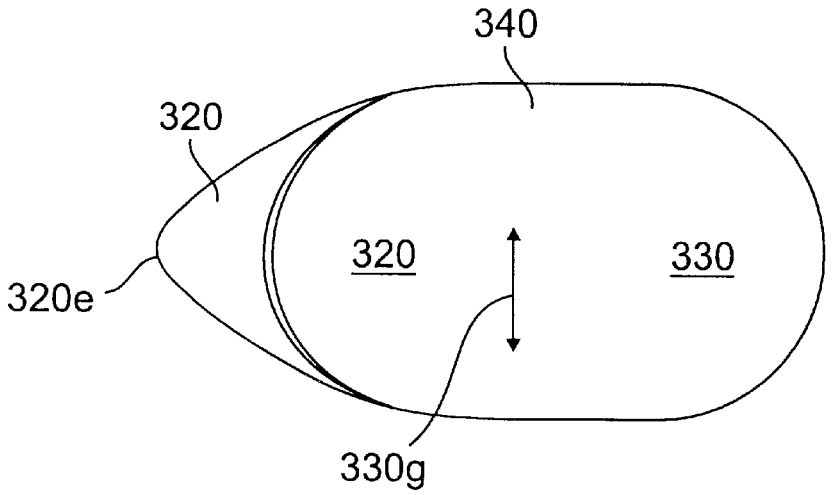
FIG. 6A is a plan view of an unfolded version of another embodiment of the pick.
Figure 6B:
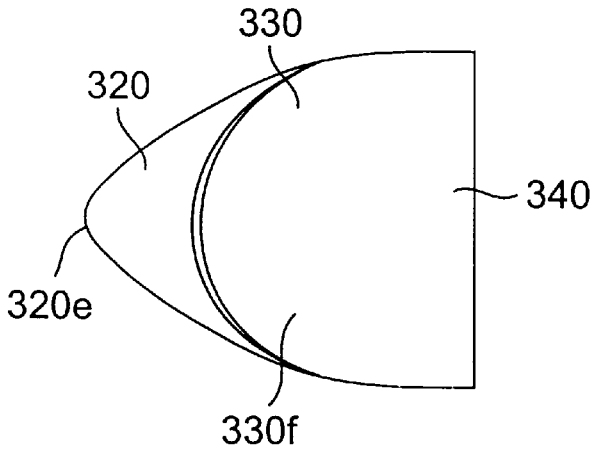
FIG. 6B is a plan view of the folded pick of FIG. 6A as used.
Figure 7:
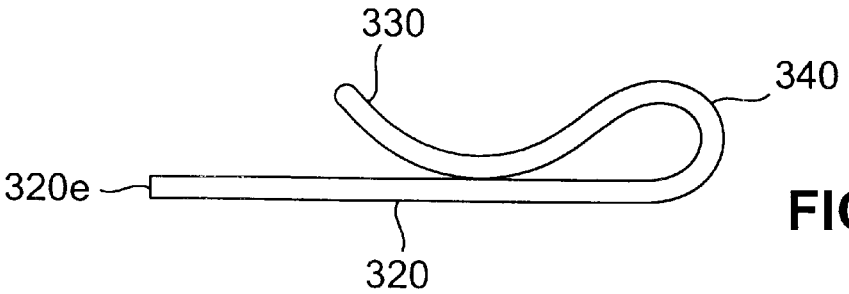
FIG. 7 is an elevational view of the pick of FIG. 6B.

In use, the pick as shown in FIGS. 1–18 may be easily and comfortably held between the thumb and index finder as shown in FIGS. 5 and 8. Here it will be seen that the pocket or channel 30*d* will snugly receive either the finger as shown in FIG. 5, or the thumb as shown in FIG. 8, depending on the preference of the user. Thus, some users may prefer the flap or grip portion 30 facing downward which will bring surface 30*d* in contact with the index finger tip as shown in FIG. 5, while others will prefer that it be on the top plane of the pick where it will be under the thumb, as shown in FIG. 8. For clarification, it will be noted that typically, in use, if the flap or grip surface 30*d* is facing upward, it contacts the thumb, whereas when it faces downward, it contacts the index finger.

The advantages of the invention may now be readily understood. Thus, we have provided a simpler, more convenient, ergonomic, and better playing pick and pick holder. Simplicity is evident in the smoothly folded one-piece construction that forms a pocket or channel which matingly receives and comfortably, yet securely, holds a finger or thumb in what be characterized as a predetermined position. As is clearly evident, the pocket or channel 30*d* properly positions the pick during play. This has been found, in fact, to be helpful as an instructional aid and corrects bad habits by forcing more specific finger orientation. The simplicity of construction allows the use of various sheetlike materials of various thicknesses, sizes, hardnesses, and flexibility to satisfy a wide range of playing conditions and user preferences. The folded configuration is efficiently manufactured and allows convenient storage of the pick, as well as other picks on the instrument strings or instrument strap during use, so that the user may quickly add or switch picks as conditions or preferences dictate. While it is known that conventional picks have been stored in engagement with the strings, it is also known that this storage of conventional picks distorts the tuning. This is not the case when our pick is stored on the strings. The ergonomic grip allows a more relaxed, low pressure grip which grip avoids physical problems, such as carpal tunnel syndrome, and tension and pain in the arm and back. It has also been found to improve concentration of the user by avoiding the distractions caused by a slipping or dropped pick. Because the pick can be held with a lighter grip, the user will not suffer pick string shock, and wear is significantly decreased for longer pick life and more consistent playing. As stated earlier, reduced direct contact of the user's finger or thumb with the pick decreases dampening to produce better sound. The ability to easily vary the amount of contact and its position allows the pick itself to be timed and effectively become a separate instrument.

While the invention has been described with particular reference to the construction shown in the drawings and while various changes may be made in detailed constuction, it shall be understood that such changes shall be within the spirit and scope of the present invention as defined by the appended claims.

From the foregoing, it will be observed that numerous variations and modifications may be effected without departing from he spirit and scope of the invention It is to be understood that no limitation with respect to the specific apparatus illustrated herein is intended or should be inferred. It is, of course, intended to cover by the appended claims all such modification as fall within the scope of the claims.

What is claimed is:

1. An improved pick device for pressure holding by a finger and a thumb and for use with a stringed instrument comprising:

a first portion of material having an inner surface and an outer surface;

a second portion forming a finger grip portion in the form of relatively thin material extending over the inner surface of said first portion, said second portion having an inner surface and an outer surface;

said second portion having a curved finger cradle configuration on said outer surface for securing engagement with pressure by the finger and the thumb;

said inner surface of said second portion facing said inner surface of said first portion.

2. An improved pick device for a stringed instrument according to claim 1, wherein said finger cradle configuration is shaped to receive therein one of the thumb and the finger of the user to hold said device.

3. An improved pick device according to claim 2, wherein said first and second portions comprise and are integrally connected in an intermediate area curving more than 180°.

4. An improved pick device according to claim 3, wherein said first portion is in the form of a plectrum having generally planar inner and outer surfaces and a surrounding edge between said surfaces.

5. An improved pick device according to claim 4, wherein said inner surface of said second portion in the area of said cradle is adjacent said inner surface of said plectrum.

6. An improved pick device according to claim 3, wherein said first and second portions and intermediate areas are made of relatively flat material that may be formed and holds it shape after being formed.

7. An improved pick device according to claim 6, wherein said device is made by the steps of forming said first and second portions of a thin material, providing a curved finger cradle area in said second portion and bending said second portion over said first portion through a bend in the order of 180°.

8. An improved pick device according to claim 7, wherein said forming step is die-cutting a flat material and said bending step includes heat treating said material.

9. An improved pick device according to claim 6, wherein said material is formed by steps including progressive die stamping.

10. An improved pick device according to claim 2, wherein said material is a metal.

11. An improved pick device according to claim 2, wherein said material is a plastic.

12. An improved pick device according to claim 2, wherein said device is made by the steps of injection molding a plastic material into a mold, allowing said material to cure, removing said device from said mold, and finishing said device.

13. An improved pick device according to claim 1, wherein inside surfaces of said first portion and said second portion cooperate to hold a separate plectrum by direct contact with outside surfaces of said plectrum when it is being held therein.

14. An improved pick device according to claim 13, wherein said plectrum has an upper and lower surface, said inner surface of said first portion being in direct contact with said lower surface of said plectrum, said inner surface of said second portion being in direct contact with said upper surface of said plectrum when said plectrum is positioned therein.

15. An improved pick device according to claim 13, wherein said device has a tab to engage a plectrum to hold said plectrum in position.

16. An improved pick device according to claim 15, wherein said tab is joined to said device at a first end and has a plectrum engaging position on a second end being at an angle to allow said plectrum to pass in a first direction but to resist passage when said plectrum is to be drawn in on opposite second direction.

17. An improved pick device according to claim 16, wherein said tab is separate from said second portion.

18. An improved pick device according to claim 16, wherein said tab depends from said second portion at an angle toward said first portion.

19. An improved pick device according to claim 15, wherein said plectrum additionally comprises a tab engagement area wherein said tab engages said area to retain said plectrum securely in position.

20. An improved pick device according to claim 19, wherein said tab engagement area in said plectrum is an opening which said tab is received into to secure said plectrum in said device.

21. An improved pick device according to claim 20, wherein said first portion has an opening aligned with said tab, whereby said tab may be received in said first portion opening when it has passed through said plectrum opening.

22. An improved pick device according to claim 15, wherein said tab has sharp pointed portions to engage said plectrum and hold said plectrum securely against movement.

23. An improved pick device according to claim 15, wherein said tab is resiliently biased toward said first portion and forcibly engages said plectrum to secure said plectrum relative to said device.

24. An improved pick device according to claim 15, wherein said tab is mechanically urged into engagement with said plectrum.

25. An improved pick device according to claim 1, wherein said device has a laterally extending space between said first and second portions sized to laterally and snugly receive an enlarged portion of a plectrum therein.

26. An improved pick device according to claim 1, wherein said device has a laterally extending open space between said first and second portions to accommodate a string of said stringed instrument, whereby said device is securely retained on said stringed instrument.

27. An improved pick device according to claim 26, wherein said space is greater in size than the diameter of said string.

28. A pick holder device for pressure holding by a finger and a thumb, and for use with a stringed instrument having a plurality of predetermined holder attachment means thereon, and further comprising a removable pick, wherein said pick may be attached to and oriented with said holder by a user in more than one way.

29. A pick holder device as in claim 28, wherein said holder attachment means are openings receiving a portion of a pick therein for secure attachment.

30. A pick holder device as in claim 28, wherein said attachment means include a slot and a straight edge portion parallel to said slot.

31. An improved pick apparatus comprising:

a pick holder having a curved finger grip portion and a pick securing tab;

a pick having a plurality of predetermined holder attachment means thereon to provide for said pick to be attached to and oriented with said pick holder in a selected one way from a plurality of ways;

said tab cooperating with said holder attachment means on said pick to secure said pick and said pick holder together in the selected one way.

32. An improved pick apparatus as in claim 31, wherein said pick holder comprises a first portion of material having an inner surface and an outer surface;

a second portion forming a finger grip portion in the form of relatively thin material extending over the inner surface of said first portion, said second portion having an inner surface and an outer surface;

said first and second portions being joined by an intermediate portion;

said second portion having a curved finger cradle configuration on said outer surface;

said inner surface of said second portion facing said inner surface of said first portion.

33. An improved pick apparatus as in claim 31, wherein said tab is resiliently biased toward said first portion, said resilient bias holding said tab in contact with said holder attachment means on said pick.

34. A holder apparatus for use by a user, the apparatus comprising:

a pick;

a pick holder having a tab adapted to engage and secure the pick to retain said pick in a fixed positional relationship to said pick holder, said pick having a tab engaging portion;

wherein said tab can be secured to said pick at any one of a plurality of various places on said pick, whereby the attitude of the pick to the holder can be easily varied by the user.

* * * * *